US005223213A

United States Patent [19]

Kamimura et al.

[11] Patent Number: 5,223,213

[45] Date of Patent: Jun. 29, 1993

[54] CAST PRODUCT HAVING A CERAMIC INSERT AND METHOD OF MAKING SAME

[75] Inventors: Tadashi Kamimura, Yokohama; Akira Tsujimura, Chigasaki, both of Japan

[73] Assignee: Isuzu Motors Limited, Tokyo, Japan

[21] Appl. No.: 646,960

[22] Filed: Jan. 25, 1991

[30] Foreign Application Priority Data

Jan. 26, 1990 [JP] Japan ..... 2-14915
Apr. 16, 1990 [JP] Japan ..... 1-100001

[51] Int. Cl.[5] ..... B22F 3/14; B22F 7/04; B22F 5/02

[52] U.S. Cl. ..... 419/35; 75/230; 419/10; 419/38; 428/552; 428/570

[58] Field of Search ..... 428/546, 552, 558, 570, 428/548, 551, 564; 419/8, 35, 38, 10; 164/97, 98, 99, 103, 107, 111; 75/230

[56] References Cited

U.S. PATENT DOCUMENTS

| | | | |
|---|---|---|---|
| Re. 32,111 | 3/1986 | Lambert et al. | 428/212 |
| 2,610,118 | 9/1952 | Drapeau et al. | 419/35 |
| 3,260,576 | 7/1966 | Gruene et al. | 428/566 |
| 3,568,723 | 3/1971 | Sowards | 164/98 |
| 3,579,390 | 5/1971 | Paine et al. | 419/32 |
| 3,708,282 | 2/1973 | Burr et al. | 419/11 |
| 3,928,662 | 12/1975 | Kaneko et al. | 427/294 |
| 4,447,501 | 5/1984 | Shigeru et al. | 428/570 |
| 4,485,150 | 11/1984 | Tsuno | 428/633 |
| 4,557,893 | 12/1985 | Jatkar et al. | 419/12 |
| 4,604,779 | 8/1986 | Nakita et al. | 29/156.4 |
| 4,614,630 | 9/1986 | Pluim, Jr. | 164/98 |
| 4,712,605 | 12/1987 | Sasaki et al. | 164/516 |
| 4,804,033 | 2/1989 | Hepworth et al. | 164/97 |
| 4,885,214 | 12/1989 | Trenkler et al. | 428/614 |
| 4,890,663 | 1/1990 | Yarahmadi | 164/98 |
| 4,908,923 | 3/1990 | Anderson et al. | 29/888.01 |
| 4,953,612 | 9/1990 | Sare et al. | 164/102 |
| 4,998,578 | 3/1991 | Dwivedi et al. | 164/6 |
| 5,052,464 | 10/1991 | Naturi | 164/80 |

*Primary Examiner*—Donald P. Walsh
*Assistant Examiner*—Daniel J. Jenkins
*Attorney, Agent, or Firm*—Dykema Gossett

[57] ABSTRACT

A cast product made from metallic material and ceramic material with the ceramic material being an insert, comprises an aggregated body of capsule particles, the capsule particle including a ceramic particle coated with metallic particles, and metallic material cast over the aggregated body.

26 Claims, 5 Drawing Sheets

CAST PRODUCT HAVING A CERAMIC INSERT AND METHOD OF MAKING SAME

BACKGROUND OF THE INVENTION

1. Technical Field

The present invention relates to a cast product having a ceramic insert such as a cylinder head, a piston and an exhaust manifold which product is repeatedly subjected to high thermal stress and a method of making such a product.

2. Background Art

Generally, a cylinder head and a cylinder liner which define a combustion chamber of an internal combustion engine are made from casting iron, respectively. Therefore, the combustion chamber is always exposed to possible breakage due to poor rigidity which is a characteristic of the casting iron, and due to residual stress from casting of the cylinder head and the cylinder liner as well as thermal stress and thermal shock exerted on the cylinder head and the cylinder liner during operation of the engine. Particularly, a so-called "valve bridge portion" (a portion between an intake port and an exhaust port and a portion between these ports and a precombustion chamber hole or a fuel injection nozzle hole) cannot possess sufficient size and thickness due to its structure. Thus, the valve bridge portion is structurely weak and cracking may occur in the elements of the valve bridge portion.

A conventional measure to overcome the above-described problems is as follows: In casting the cylinder head, different metal is inserted to those portions which require high strength as disclosed in Japanese Utility Model Registration Application Second Publication No. 48-25923 and hardening of various degrees is applied to the intermediate product in accordance with thermal stress occurring in the final product during the operation of the engine as disclosed in Japanese Utility Model Registration Application Second Publication No. 63-8831.

However, recent engines have very high output and accordingly the thermal stress and mechanical load on the parts around the combustion chamber have increased greatly. Thus, reinforcement of those parts which are subjected to high thermal stress is not enough to eliminate the possibility of cracking.

On the other hand, a surface insulation treatment is applied to the parts around the combustion chamber in order to suppress thermal fatigue due to a temperature increase, as one aspect of improving the engine performance. One way of surface insulation is disclosed or instance in Japanese Utility Model Application Laid-Open No. 59-85348. In this application, a part of the cylinder head on the combustion chamber side is formed by ceramic material. This prevents cracking and improves thermal insulation properties.

FIGS. 17 and 18 show a cylinder head arrangement in line with the above proposal, in a plan view, and a sectional view, respectively. As illustrated, a recess portion 5 is formed at a valve bridge portion 4 between an intake port 1 and an exhaust port 2 of a cylinder head. A fuel injection nozzle installation hole 3 is bored in the valve bridge portion 4. The recess portion 5 is filled with ceramic material which forms a ceramic layer 6.

However, in a cylinder head made from cast iron, there is no adequate technique to join the cast iron material with the ceramic material. Therefore, the ceramic layer should be applied on the combustion chamber side cylinder head by bolts. The bolting cannot ensure a sufficient joint and consequently the ceramic part, which is a brittle part, may be broken due to vibrations during engine operation.

In another example, a ceramic port liner is inserted in the exhaust manifold in order to raise turbocharging efficiency by a thermal insulation of internal exhaust gas. In such a structure, the ceramic liner is cast as an insert as the exhaust manifold is cast. This raises the problem that the brittle ceramic part will be broken by a thermal expansion difference between the ceramic part and the cast iron part and stress produced upon solidification shrinkage. Even if the cracking does not appear during and after the casting operation, the parts may be broken by vibrations during the engine operation.

Another joint technique for the cast iron and the ceramic part has been proposed. An appropriate amount of metallic particles is mixed with ceramic particles and the mixture is sintered. Then, the sintered element is cast as an insert. According to this technique, the metallic particles are metallographically joined with the melt of cast iron. As a result, the ceramics and the cast iron are combined with each other very tightly.

The above proposal, however, has following drawbacks: First, if the ceramic particulates and the metallic particulates exist in a segregated state in the product, the thermal strength, the thermal insulation property and a deformation-resistance of the product are lowered and the durability of the product is shortened. In addition, it is very difficult to manufacture a product having the ceramic particulates and the metallic particulates distributed homogeneously. Very strict quality control is required to obtain a homogeneous product.

SUMMARY OF THE INVENTION

An object of the present invention is to improve the strength and thermal insulation ability of a cast product.

Another object of the present invention is to provide a cast product having a ceramic insert whose joint with the cast iron is improved when the ceramic insert of sufficient strength and thermal insulation ability is cast as insert in the cast iron.

Still another object of the present invention is to obtain a ceramic product which has no segregation in structure, is suitable for mechanical cutting and has no cracking.

Yet another object of the present invention is to obtain a product in which the ceramic particulates and the metallic particulates are homogeneously mixed with each other.

According to one aspect of the present invention, there is provided a cast iron product having a ceramic insert, which product comprises a group of capsule particulates of ceramic particulates covered with metallic particulates and metallic material which the group of capsule particulates is inserted in.

The group of capsule particulates include capsule particulates of predetermined configuration and the capsule particulates are formed from powder compacts.

The group of capsule particulates may be a sintered body made from powder compacts of the capsule particulates.

The ceramic particulates are preferably hollow ceramic particulates.

A diameter of the ceramic particulate may be approximately between 10 and 500 micrometers.

A diameter ratio of the ceramic particulate to the metallic particulate may be about 10 to 1.

The ceramic particulate may be $Al_2O_3$.

The ceramic particulates may be volcanic ash sand soil grains. These soil grains may be "Shirasu". The "Shirasu" may have a grain size of 74 micrometers or below as its 40 to 60 weight percent and 47 to 420 micrometers as its 50 to 40 weight percent or 120 micrometers or below as its 30 to 40 weight percent.

The metallic particulates may be iron metal or stainless material.

The metallic particulates may be cast iron.

The group of particulates are preferably positioned in those portions of the product which are exposed to high thermal stress. The group of particulates may be a sintered body or a compact defining a combustion chamber. The group of particulates may be a sintered body or a compact defining an inner wall of an exhaust manifold of the engine. The inner wall of the exhaust manifold may be the inner wall at the entrance of the exhaust manifold. The group of the particulates may be a sintered body or a compact defining a lower portion of the cylinder head and/or an exhaust port liner.

According to another aspect of the present invention, there is provided a method of making the above-mentioned product. Specifically, there is provided an improved method of manufacturing a cast iron product having a ceramic member as an insert, comprising the steps of: forming capsule particulates by covering ceramic core particulates with metallic coating particulates; forming a powder compact of predetermined configuration using the capsule particulates; and casting metallic material such as cast iron over the powder compact and simultaneously sintering the powder compact.

According to still another aspect of the present invention, there is provided a method of manufacturing a cast iron product having a ceramic insert, comprising the steps of: forming capsule particles by coating ceramic core particles with metallic coating particles; forming a powder compact of predetermined shape using the capsule particles; forming a sintered body by sintering the powder compact; and casting metallic material such as cast iron over the sintered body to form a ceramics-inserted cast product.

The capsule-particle-forming step may include the steps of: forming a powder body (fine particle) to be treated (an intermediate product), by allowing a number of metallic particles to adhere on a surface of a ceramic particle whose diameter is larger than the diameter of the metallic particle; and applying shock or the impulsive effect of high speed air flow on the powder body or the fine particle to admit the metallic particles to bite or intrude into the ceramic particles so as to form a capsule particle.

The capsule-particle-forming step may be performed by a powder shock-applying machine or a rolling machine.

The powder-compact-forming step may be a step of pressure-compacting powders of capsule particles.

The sintering step may include a sintering operation at a temperature between about 900° C. and about 1,000° C.

According to the present invention, the ceramic elements are added to the product in a desirable condition so that the strength and the heat insulation property of the product are improved. In addition, the surface of the powder compact or the sintered body is changed to the metal so that the joint with the cast iron becomes easier or casting of the cast iron over the powder compact or the sintered body becomes easier. Furthermore, the ceramic elements are uniformly distributed in the final product so that the possibility of cracking is eliminated. Moreover, the metallic particles makes the mechanical cutting easier.

Particularly, if the ceramic particles have hollow portions to contain air therein, the thermal insulation is further improved by layers of air. Also, if volcanic ash sand soil grains such as "Shirasu" are used as the hollow ceramic particles, a ceramic element manufacturing cost is reduced.

Van der Waals forces are used when the metallic particles are forced to adhere on the surface of the ceramic particle. However, the adhesion between dissimilar particles is not always enough at this point. Therefore, in order to form the capsule powder, the impulsive forces of the high speed air is applied to the surface, which is formed by a number of metallic particles adhered on the ceramic core, of the ceramic core such that the metallic particles intrude into the ceramic core. This provides a strong joint between the dissimilar particles. Specifically, individual ceramic particles are covered with or enclosed by the metallic particles with strong joint force. Therefore, when the powder compact is made from these capsule powders, the ceramic particles and the metallic particles are homogeneously mixed with each other in the powder compact.

At the next step, the compact of capsule powders is sintered to obtain a sintered body. Then, the cast iron is cast over the sintered body. Alternatively, the compact is sintered and at the same time, the cast iron is cast over the compact. At the step of sintering the compact and the step of casting the cast iron over the compact or the sintered body, the metallic particles covering the ceramic particles and the other metallic particles are metallurgically joined with each other, and the combined metal and the cast iron are metallurgically joined with each other, so that the metallic cast product contains the ceramic particles as the insert. This means that the compact of capsule powders and the cast iron are firmly joined with each other. Therefore, the heat resistance, the thermal insulation property and the deformation resistance of the final product are improved.

DESCRIPTION OF THE PREFERRED EMBODIMENTS

Now, preferred embodiments of the present invention will be explained.

Figure 1:
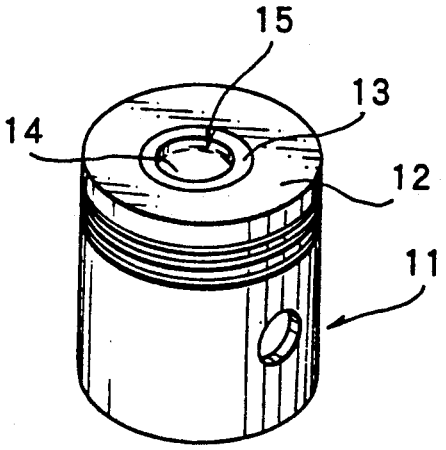
FIG. 1 is a perspective view showing a piston head of an embodiment of the present invention.
Figure 2:
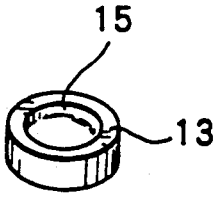
FIG. 2 is a perspective view showing a combustion chamber lateral wall of the piston head of FIG. 1.

FIGS. 1 and 2 illustrate a cast iron piston 11 having ceramic particles as an insert according to a first embodiment of the present invention. In a piston head 12 of the piston 11, a powder compact or sintered body 13 made from capsule particles is cast as an insert. The powder compact or sintered body 13 includes ceramic particles (cores) and metallic particles (coating particles) surrounding the ceramic particles. A combustion chamber 14 is defined by the powder compact 13. In other words, a wall 15 of the combustion chamber 14 is formed by homogeneously distributed firmly added ceramic particles.

This piston 11 is exposed to high temperature combustion gas and thermal stress repeatedly, but cracking does not appear in the combustion chamber wall of the cast iron piston since the piston 11 has the above construction.

Figure 3:
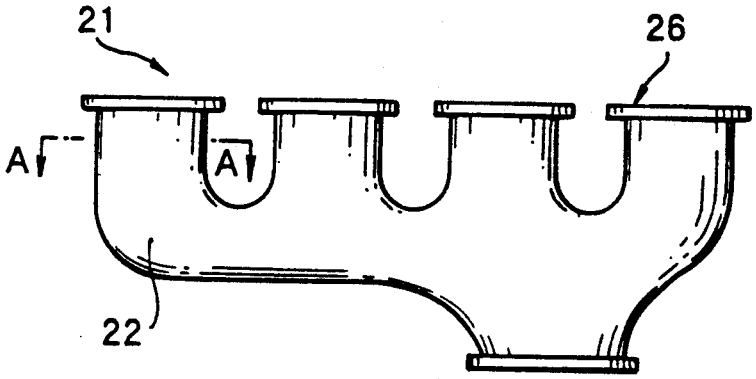
FIG. 3 is a perspective view of an exhaust manifold according to a second embodiment of the present invention.
Figure 4:
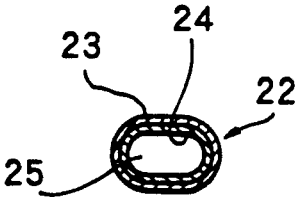
FIG. 4 is a view taken along the line A—A of FIG. 3.

FIGS. 3 and 4 show a second embodiment of the present invention. Numeral 21 designates a cast iron exhaust manifold having ceramic particles as insert. A powder compact (sintered body) 23 made from the capsule particles are cast in an inner wall of the exhaust manifold. An inner wall 24 of the powder compact 23 defines an exhaust gas passage 25.

A cast location of the powder compact 23 may be a connecting portion 26 between the exhaust manifold 21 and a cylinder head (not shown) or may be an entire inner wall of the exhaust manifold 21.

Figure 5:
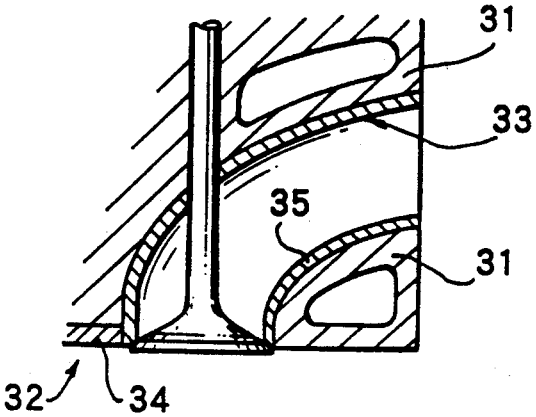
FIG. 5 is a sectional view of major portions of a cylinder head according to a third embodiment of the present invention.
Figure 6:
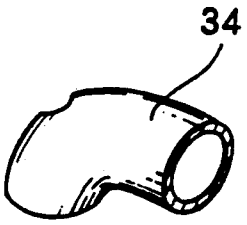
FIG. 6 is a perspective view of an exhaust port liner of FIG. 5.

FIGS. 5 and 6 show a third embodiment of the present invention. In a lower portion 32 (a valve bridge portion) of a cast iron cylinder head 31 and an exhaust port liner 33 of the cylinder head 31, powder compacts (sintered bodies) 34 and 35 made from the above-described capsule particles are cast as an insert.

Since the lower portion 32 of the cylinder head and the exhaust port liner 33 include the powder compacts 34 and 35 respectively, the heat resistance, the thermal insulation ability and the deformation resistance of these elements are improved. In addition, cracking does not appear in these elements even if thermal stress is repeatedly applied to them.

Now, a method of making the cast iron product having a ceramic element as an insert, as mentioned in the first and third embodiments will be explained as a fourth embodiment of the present invention.

Major steps of the method are: forming capsule particles; forming a powder compact from the capsule particles; and performing a casting with the powder compact as an insert.

The capsule particle forming steps may be carried out by a fine-particle shock-applying machine and peripheral equipment thereof (FIG. 9) and the shock-applying machine will be explained.

As illustrated, a disk 44 is mounted on a shaft 43 rotatably supported by a casing 42 and a plurality of shock-applying pins 45 are provided on the outer periphery of the disk 44 at predetermined intervals and extend in the radial direction of the disk 44.

The disk 44 is adapted to rotate at a high speed. A collision or impact ring 46 is provided around the disk 44 with a predetermined clearance. The impact ring 46 is mounted on the inner wall of the casing 42. The impact ring 46 is cut out at a lower portion 47 thereof and a valve 48 is provided at the cut out portion 47 of the ring 46.

The valve 48 is connected to a valve stem 50 which serves as a rod of the actuator 49 and up-and-down movement of the valve stem 50 opens and closes the cut out 47.

A clearance between the outer periphery of the disk 44 and the impact ring 46 defines an impact chamber 51 for applying a shock or an impulsive force to the fine particles. The impact chamber 51 has a circulation opening 52 and a circulation passage 53 extends from the opening 52 to a central portion of the disk 44.

The fine particles are fed into the chamber 51 through a feed chute 55 connecting the passage 53 with a hopper 54. A predetermined impulsive force is applied to the fine particles and the fine particles are discharged from a discharge chute 56 as the valve 48 moves.

The peripheral equipment of the impact machine 41 includes a raw material weighing feeder 57 which transfers the fine particles to the raw material hopper 54, a raw material storage 58 provided upstream of the feeder 57 and a preprocessor 59 for feeding the fine particles to the storage 58.

Other peripheral equipment includes a cyclone 60 for receiving the fine particles discharged from the impact chamber 51, a rotary valve 61 provided for the cyclone 60, a bag filter 63 having another rotary valve 62, a blower 64 and a controller 65 for controlling the raw material weighing feeder 57, the disk 44 and the actuator 49.

Next, a process of making the capsule particles will be explained.

Figure 7:
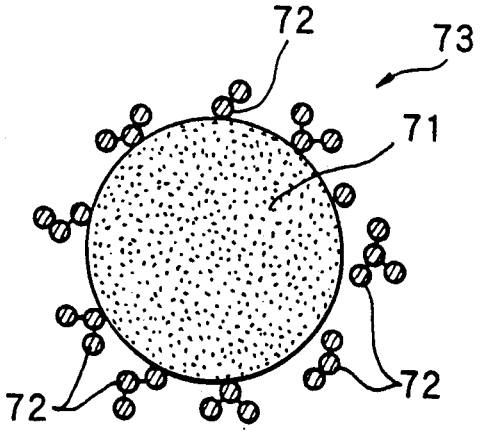
FIG. 7 shows a fourth embodiment of the present invention with a section view illustrating a step of metallic particle adhesion on ceramic particle surface.

As illustrated in FIG. 7, ceramic particles 71 of 10–500 micrometer (in diameter) are prepared. These ceramic particles 71 may be fine particles of $Al_2O_3$. In addition, metallic particles 72 having a diameter smaller than the ceramic particle, for example one-tenth of the ceramic particle, are prepared. The metallic particles may be iron metallic particles.

The metallic particles 72 are applied on the surface of the ceramic particle 71 such that the metallic particles 72 adhere thereon. The adhesion is carried out by the preprocessor 59 with use of van der Waals forces.

Each particle 73 has the alumina particle 71 and the metallic particles 72 around the alumina particle 71. The particles 73 are fed from the preprocessor 59 to the raw material storage 58.

At that time, the valve 48 of the impact machine 41 is closed, and inert gas is fed into the machine 41 while the shaft 44 is rotated. The rotation speed of the disk 44 is adjusted between 8,000 to 16,000 rpm by the controller 65. The rotation of the disk 44 rotates the pin 45 mounted on the outer periphery of the disk 44 and produces air flow therearound. A fan effect due to a centrifugal force of the air flow forms a circulation flow extending from the opening 52 of the chamber 51 to the central portion of the disk 44 through the passage 53.

After the circulation flow is formed, the treated fine particles 73 in the storage 58 are thrown into the hopper 54 by the feeder 57. The fine particles 74 enter the impact chamber 51 from the raw material hopper 54 through the chute 55. In the chamber 51, a number of pins 45 of the disk 44 which rotates at a high speed, apply instantaneous shock to the fine particles 73. Then, the fine particles 73 collide against the ring 46 such that a second shock and a strong compressing force are applied to the fine particles 73. After that, the fine particles 73 flow into the circulation passage 53 with the circulating gas flow and reach the chamber 51 again, as indicated by the arrow "arrow". Then, the fine particles 73 are exposed to the shock again.

Therefore, the fine particles 73 face the impulsive force repeatedly within a short period of time. The time required may be about 1 to 10 minutes. During that period of time, the surface of the ceramic particle 71 is given thermal energy so that the metallic particles 72 or the ceramic particle 71 is softened or melt within a short period of time, whereby the metallic particles 72 are distributed homogeneously on the surface of the ceramic particle 71. In other words, the ceramic particle 71 is covered with the metallic particles 72 whereby the coated capsule particle (powder body) 74 which has the ceramic particle 71 as the core and the metallic particles 72 around the ceramic particle 71 is manufactured.

Figure 9:
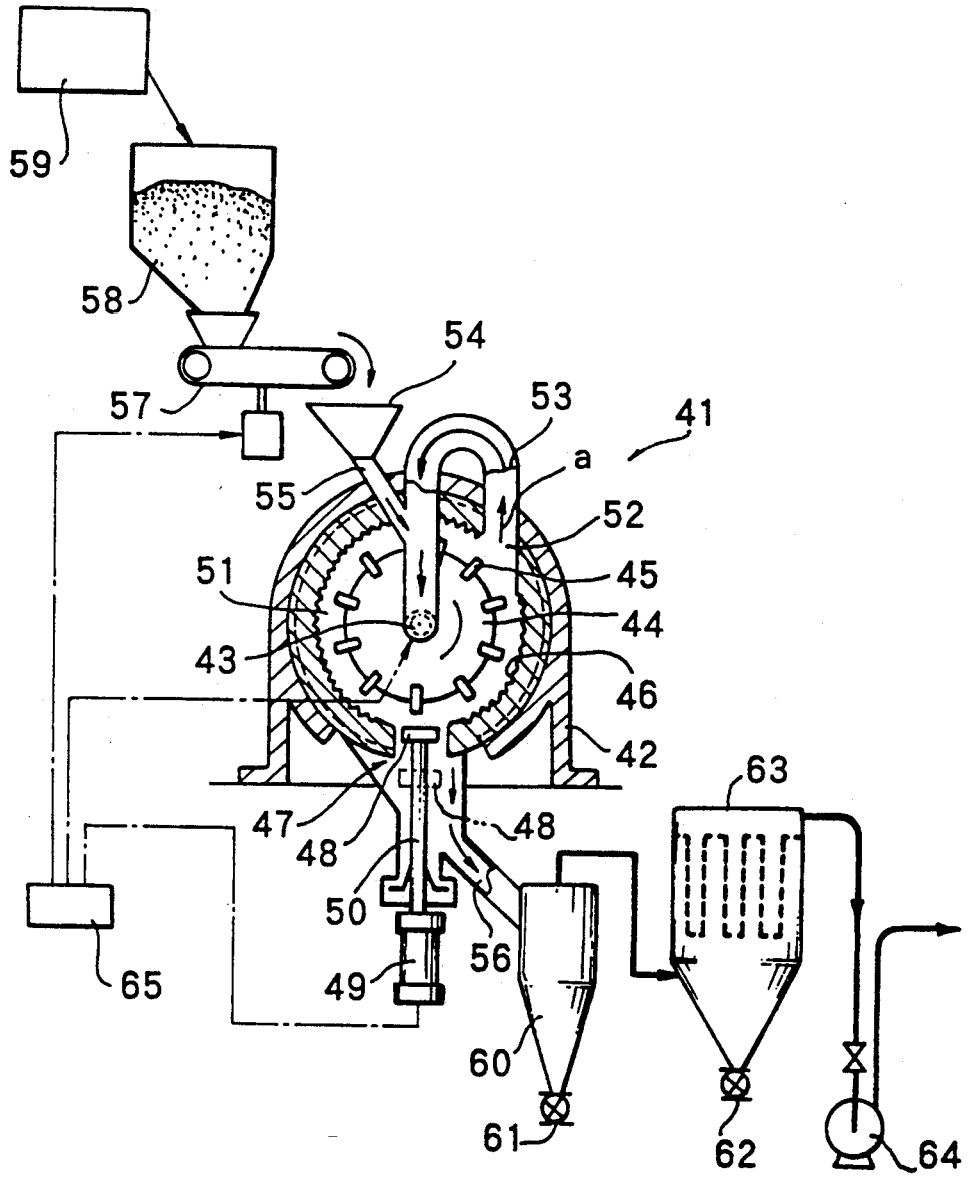
FIG. 9 shows a powder impacting machine used to carry out a method of making a cast product having ceramic particles as insert.

After the capsule particle 74 is prepared, the valve 48 is moved to a position indicated by the double-dot line of FIG. 9 so that the cut out portion 47 is opened to discharge the capsule particles 74 from the chamber 51.

Figure 8:
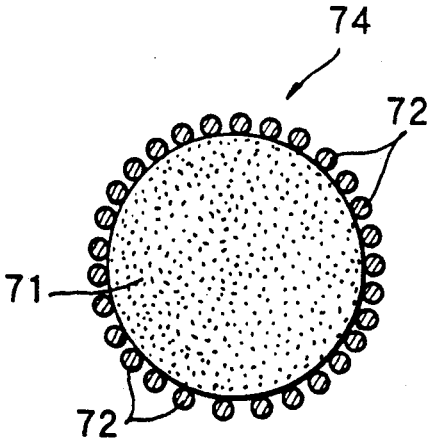
FIG. 8 shows a sectional view of a capsule particle.

The centrifugal force exerted on the capsule particles 74 and the suction force of the blower 64 discharge the capsule particles 74 from the chamber 51 and the circulation passage 53 within a short period of time (several seconds), as shown in FIG. 8. Then, the capsule particles 74 are introduced to the fine particle collecting mechanism (the cyclone 60 and the gas filter 63) through the discharge chute 56. The capsule particles 74 are expelled outside by the rotary valves 61 and 62.

Next, the capsule particles 74 are pressurized and shaped to predetermined configurations. In other words, as shown in FIGS. 2, 4 or 6, there are formed the powder compact 13 defining the combustion chamber 14 of the piston head 12, the powder compact 24 defining the exhaust gas passage 25 of the exhaust manifold 21 and the powder compact 34 defining the port liner 33 of the cylinder head 31.

The powder compacts 13, 24 and 34 are located in respective casting molds (not shown) and metallic melt (iron) are added into the casting molds whereby the desired piston 11, the exhausted manifold 21 and the cylinder head 31 are cast. Therefore, the powder compacts 13, 24 and 34 are sintered by the high temperature molten metal and at the same time, the powder compacts become the inserts of the respective cast products.

Alternatively, the powder compacts 13, 24 and 34 may undergo the sintering, like a normal sintering of the metal, by a sintering furnace at a sintering temperature of the metal.

The final products obtained are shown in FIGS. 1 to 6.

Since the capsule particles 74 are used, the individual ceramic particles 71 are covered with the metallic particles 72 with a strong bonding force. Therefore, there are obtained products having the ceramic particles 71 and the metallic particles 72, both particles being distributed homogeneously in the product, without strict quality control.

The product has an excellent thermal resistance, a thermal insulation property and a deformation resistance. In addition, in the product which has the ceramic particles as the inserts, the ceramic particles 71 and the metallic particles 72 covering the ceramic particles 71 are metallurgically combined with each other. Further, when the casting of the cast iron is performed with the powder compacts 13, 24 and 34 as the inserts, the metallic particles around the ceramic particles are metallurgically combined with the cast iron. Therefore, the problem of the brittleness of the ceramics is eliminated. Consequently, the thermal resistance, the thermal insulation and the deformation resistance of the product is improved and the strength and the longevity of the product is also improved.

In this way, the manufacturing method of the present invention eliminates all the problems of the conventional cast iron product having ceramic as the insert. The method of the present invention widens the field of use of the ceramic products remarkably.

In the powder compact or the sintered body, since the ceramics is coated with the metal, stress which would be produced upon thermal expansion and solidification shrinkage with respect to the casting base metal. As a result, the castability is improved and crackings do not appear. In addition, mechanical cutting of the product becomes as easy as the metal itself.

A ratio of the metallic portion to the ceramic portion is 30 to 70 at maximum and the metallic portion may be reduced relative to the ceramic portion. Therefore, if it is desired to further improve the thermal resistance, the thermal insulation ability and the deformation resistance, the metallic portion (metallic particles) will be reduced. On the other hand, if the product is often subject to vibrations and shock the metallic portion is increased in order to reduce the brittleness of the ceramic.

The present invention may be applied to products other than those illustrated in FIGS. 1 to 6.

Next, a fifth embodiment of the present invention will be described with reference to FIGS. 10 to 17.

Figure 10:
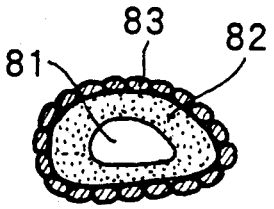
FIG. 10 is a view useful to explain a fifth embodiment of the present invention, showing a sectional view of a particle of a hollow ceramic particle and metallic particles adhering on the ceramic particle.
Figure 11:
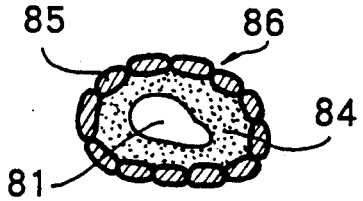
FIG. 11 is a sectional view of a capsule particle.

In this particular embodiment, the ceramic particle 82 having a hollow portion 81 is employed, as shown in FIGS. 10 and 11. Like the forth embodiment, the ceramic particle 82 is coated with the metallic particles 83. The metallic particle 83 has a smaller diameter than the ceramic particle 82, for example one-tenth of the ceramic particle. The metallic particles 83 are forced to adhere on the ceramic particle 82 and the impulsive force is applied to them such that the metallic particles 83 firmly adhere on the cearmic particle 82. In this manner, there is obtained the capsule particle 86 which has the hollow ceramic particle 82 as the core particle 84 and the metallic particles 83 as the coating particles 85, as shown in FIG. 11.

Figure 12:
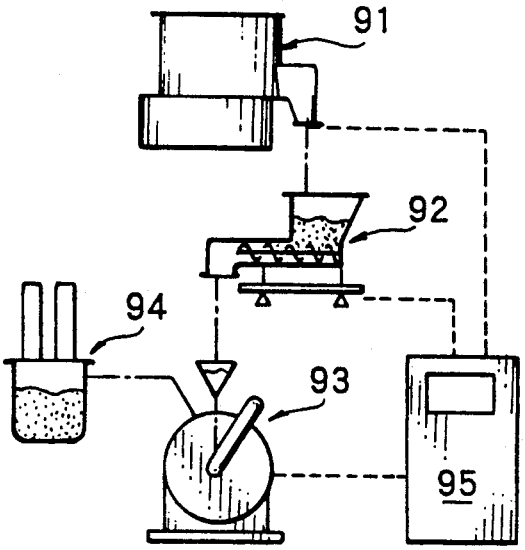
FIG. 12 depicts a system for manufacturing the capsule particles.
Figure 13:
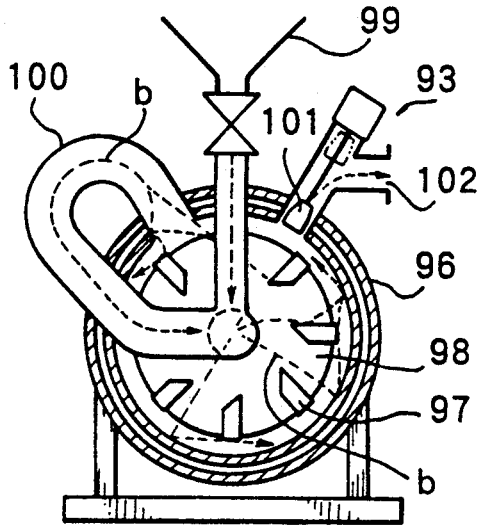
FIG. 13 depicts a sectional view of a rolling machine of the system of FIG. 12.
Figure 15:
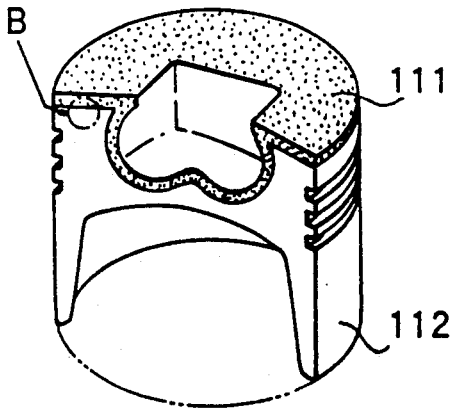
FIG. 15 is a partial sectional view of a piston which is a cast product having a ceramics as an insert arroding to the fifth embodiment.

The capsule particle 86 may be manufactured by the system of FIG. 9, but here another system is employed and illustrated in FIGS. 12 and 13.

The system is used to manufacture the capsule particles in a dry manner. The system includes an electrostatic device 91, a feeding apparatus 92, a rolling device (hybridizer) 93 and a powder body collecting device 94. The electrostatic device 91 is used to force small particles to adhere to a base particle. The small particle has a diameter smaller than the base particle. The feeding machine 92 is used to transfer the base particles having the smaller particles thereon. The rolling machine 93 is used to apply the shock or the impulsive force to the particles. The collecting machine 94 is used to receive the manufactured capsule particles. These devices 91, 92 and 93 are controlled by a controller 95.

As shown in FIG. 13, a rotor 98 is rotatably provided in the rolling machine 93. The rotor 98 includes a stator 96 and the stator 96 has blades 97. The particles to be treated, fed from a chute 98 are blown off or scattered by the centrifugal force of the roller 98, as indicated by the broken line "b". During the process, the particles impinge on the inner wall of the stator 96 and the blades 97 so that the impulsive force is applied to the particles, and the particles are repeatedly thrown into the high speed air flow by the circulation passage 100. Then, when a discharge valve 101 of the stator 96 is opened, the capsule particles are discharged from an outlet port 102.

The hollow ceramic particles 82 and the metallic particles 83 adhering on the ceramic particles are thrown into the rolling machine 93 and the impulsive force is applied to the particles by the high speed air flow for about 1 to 10 minutes. The rotational speed of the rotor 98 is between 8,000 and 16,000 rpm. The product 86 is the capsule particle whose elements are joined with each other firmly.

The method of making the capsule particle 86 is not limited to the above-described method, but may be a known wet method.

Next, the fine particles (a number of the capsule particles 86) are shaped to a predetermined configuration, like the normal sintering of the metal, and then sintered by the sintering furnace at the sintering temperature of the metal.

Figure 14:
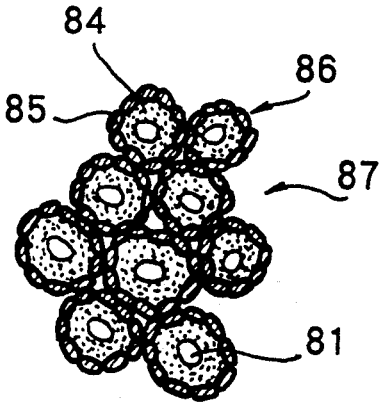
FIG. 14 depicts a sintered body of the capsule particles.

The resulting product is the sintered body 87 of FIG. 14. In other words, there is obtained an aggregated body of the hollow ceramic particles 82 and the metallic particles (coating particles) 85. The surface of the sintered body 87 is coated with the metal. This is the same situation as that the plating is applied to the ceramics.

The sintered body 87 and the cast iron are cast with the sintered body 87 being the insert, like the fourth embodiment, and the cast product having the ceramics as the insert is obtained.

In this manner, since the sintered body 87 is formed by the capsule particles 86 which have the hollow ceramic particles 82 as the insert, the cast product having the sintered body 87 as the insert has a further improved thermal insulation ability. Specifically, since the core particles are the hollow particles, the air layers in the hollow portions further improve the thermal insulation ability.

Stainless fine particles (SUS 304) may be used as the coating particles 85 for the capsule particles 86. In such a case, the sintering temperature is between about 900 and about 1,000° C.

Figure 16:
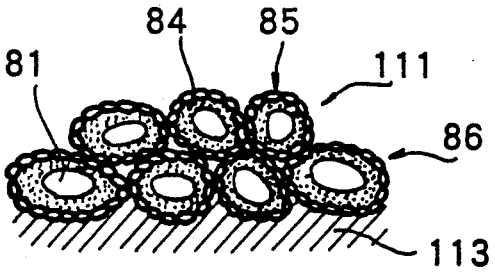
FIG. 16 is an enlarged view of the "B" section of FIG. 15.
Figure 17:
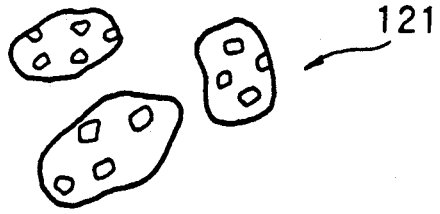
FIG. 17 schematically illustrates volcanic ash sand soil grains "Shirasu" which are used as hollow ceramic particles.
Figure 18:
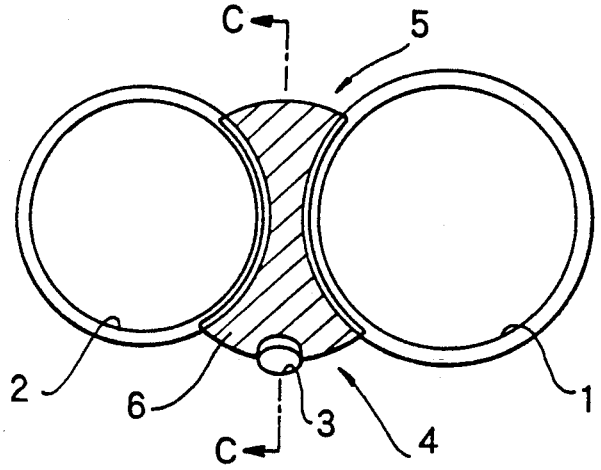
FIG. 18 is a plan view of a cylinder head of a conventional arrangement.
Figure 19:
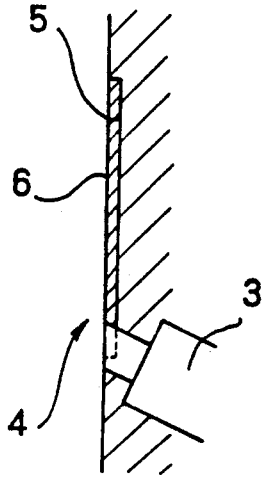
FIG. 19 is a sectional view taken along the line C—C of FIG. 18.

The fifth embodiment may be used in the same field as the fourth embodiment. For example, the fifth embodiment may be used as the thermal insulation element of the top of the piston (cast iron), as shown in FIG. 16.

In other words, the sintered body 111 having a shape of combustion chamber at the piston top is made from the capsule particles 86. The sintered body 111 is placed in the casting mold (not shown) for casting the piston body 112 and the molten metal is poured thereinto. At this time, the molten metal reacts with the metal (coated particles 85) in the surface of the sintered body 111 and joined with the surface of the sintered body 111, as shown in FIG. 16. Thus, the cast iron 113 is cast over the sintered body or the sintered body becomes the insert of the cast iron product.

The sintered body 111 is coated with the metal in terms of particle-level so that the metallic coating layer serves as a stress absorber when the cast iron is solidified. In addition, the thermal expansion of the product is similar to the cast iron ($13\times10^{-6}$ 1/° C.) so that there is possibility of cracking due to the thermal expansion.

The hollow ceramic particles may be porous volcanic ash sand soil grains which exist in nature. For example, soil grains 121 ("Shirasu") of FIG. 17 may be used. "Shirasu" commercially available from Taiheiyo Kinsetsu Co., Ltd. of Japan, can be found in Kyushu area of Japan and contains porous pumices an volcanic glasses as its major components. The grain size of so-called "fined Shirasu" is below 74 micrometers for 40 to 60% thereof (weight percent) and between 74 to 420 micrometers for 50 to 40%. The grain size of so-called "coarse Shirasu" is 120 micrometers for 30 to 40% of its weight.

By using Shirasu, the process of preparing the hollow ceramic particles can be omitted and the manufacturing cost is reduced.

We claim:

1. A cast product made from metallic material and ceramic material with the ceramic material being an insert comprising:

an aggregated body of capsule particles, each of the capsule particles including a ceramic particle having substantially the entire surface thereof coated with a plurality of metallic particles; and metallic material cast over the aggregated body, the coating of metallic particles penetrating into the surface of the ceramic particle and having a thickness sufficient to metallurgically bind the metallic cast material with the ceramic insert defined by the ceramic particles.

2. The cast product of claim 1, wherein the aggregated body includes a powder compact which is formed by the capsule particle.

3. The cast product of claim 1, wherein the aggregated body includes a sintered body which is formed by sintering a powder body of the capsule particle.

4. The cast product of claim 1, wherein the ceramic particle is a ceramic particle having a hollow section.

5. The cast product of claim 1, wherein the grain size the ceramic particle is between about 10 to about 500 micrometers.

6. The cast product of claim 1, wherein a ratio of the grain diameter of the ceramic particle to the grain diameter of the metallic particle is approximately 10 to 1.

7. The cast product of claim 1, wherein the component ratio of the ceramic particles to the metallic particles is 70 to 30 or less.

8. The cast product of claim 1, wherein the ceramic particles include $Al_2O_3$.

9. The cast product of claim 1, wherein the ceramic particles include porous volcanic ash sand soil grains.

10. The cast product of claim 9, wherein the volcanic ash sand soil grains include "Shirasu".

11. The cast product of claim 10, wherein the "Shirasu" includes grains below 74 micrometers in grain size for 40 to 60% of its weight and grains between 74 to 420 micrometers for 50 to 40% of its weight.

12. The cast product of claim 10, wherein the "Shirasu" includes grains below 120 micrometers in grain size for 30 to 40% of its weight.

13. The cast product of claim 1, wherein the metallic particles include iron metal.

14. The cast product of claim 1, wherein the metallic particles include stainless steel.

15. The cast product of claim 1, wherein the metallic material includes cast iron.

16. The cast product of claim 1, wherein the aggregated body includes a compact or a sintered body which defines a combustion chamber formed in a piston head.

17. The cast product of claim 1, wherein the aggregated body includes a compact or a sintered body which defines an inner wall of an exhaust manifold.

18. The cast product of claim 17, wherein the inner wall is an inner wall at an entrance of the exhaust manifold.

19. The cast product of claim 1, wherein the aggregated body is a compact or a sintered body to define a lower portion of a cylinder head and/or an exhaust port liner.

20. A method of making a cast product using a metallic material and a ceramic material with the ceramic material being the insert, comprising the steps of:

(A) forming a capsule particle by forcing a number of metallic particles on the surface of a ceramic particle such that the metallic particles adhere on the ceramic particle, the diameter of the metallic particle being smaller than that of the ceramic particle so as to form an intermediate product, and applying a shock effect by high speed air flow, to the intermediate product such that the metallic particles penetrate into the ceramic particle to obtain the capsule particles;

(B) forming a powder compact of predetermined shape from the capsule particles; and (C) casting the metallic material over the powder compact and simultaneously sintering the powder compact, the metallic particles forming a coating on the ceramic particles sufficient in thickness to metallurgically bind the metallic material cast in step (C) with the ceramic insert defined by the ceramic particles.

21. The method of claim 20, wherein the capsule particle forming step is carried out using a fine-particle shock-applying machine or a rolling machine.

22. The method of claim 20, wherein the powder compact forming step includes pressurizing and shaping the capsule particle.

23. A method of making a cast product using a metallic material and a ceramic material with the ceramic material being the insert, comprising the steps of:

(A) forming a capsule particle by forcing a number of metallic particles on a surface of a ceramic particle such that the metallic particles adhere on the ceramic particle, the diameter of the metallic particle being smaller than that of the ceramic particle so as to form an intermediate product, and applying a shock effect using high speed air flow, to the intermediate product such that the metallic particles penetrate into the ceramic particle to obtain the capsule particle;

(B) forming a powder compact of predetermined shape from the capsule particles;

(C) sintering the powder compact to form a sintered body; and (D) casting the metallic material over the sintered body to form the cast product, the metallic particles forming a coating on the ceramic particles sufficient in thickness to metallurgically bind the metallic material cast in step (D) with the ceramic insert defined by the ceramic particles.

24. The method of claim 23, wherein the capsule particle forming step is carried out using a fine-particle shock-applying machine or a rolling machine.

25. The method of claim 23, wherein the powder compact forming step includes pressurizing and shaping the capsule particle.

26. The method of claim 23, wherein the sintered body forming step includes sintering at temperature between about 900 and about 1,000° C.

* * * * *